United States Patent [19]

Lyons

[11] Patent Number: 5,045,982

[45] Date of Patent: Sep. 3, 1991

[54] WIDE ANGLE WARNING LIGHT

[75] Inventor: H. Wayne Lyons, Killingworth, Conn.

[73] Assignee: Whelen Technologies, Inc., Chester, Conn.

[21] Appl. No.: 452,966

[22] Filed: Dec. 19, 1989

Related U.S. Application Data

[63] Continuation-in-part of Ser. No. 324,892, Mar. 17, 1989, abandoned.

[51] Int. Cl.[5] ..... F21V 7/00

[52] U.S. Cl. ..... 362/241; 362/304; 362/346; 362/347

[58] Field of Search ..... 362/61, 80, 236, 243, 362/237, 240, 297, 304, 346, 347, 241

[56] References Cited

U.S. PATENT DOCUMENTS

| | | | |
|---|---|---|---|
| 4,208,704 | 6/1980 | Draper | 362/350 X |
| 4,386,824 | 7/1983 | Draper | 362/346 X |
| 4,680,679 | 7/1987 | Dilovya | 362/61 |
| 4,722,033 | 1/1988 | VanDuyn et al. | 362/289 X |
| 4,730,240 | 3/1988 | van Meel et al. | 362/350 X |
| 4,740,871 | 4/1988 | Dilovya | 362/80 |
| 4,754,374 | 6/1988 | Collot | 362/80 X |
| 4,825,344 | 4/1989 | Ichihara et al. | 362/346 X |
| 4,954,938 | 4/1990 | Lyons | 362/304 X |

*Primary Examiner*—Stephen F. Husar

*Attorney, Agent, or Firm*—Chilton, Alix & Van Kirk

[57] ABSTRACT

A dual emitter light assembly employs a reflector having a pair of concave reflector dishes. Each dish is associated with a lamp socket. Each concave dish comprises at least three parabolic reflector surfaces having a common focal point. The axes of the parabolas of revolution which define the reflector surfaces are non-parallel and lie in a common plane, the axis of both dishes lying in the same plane.

24 Claims, 8 Drawing Sheets

WIDE ANGLE WARNING LIGHT

CROSS-REFERENCE TO RELATED APPLICATION

This application is a continuation-in-part of application Ser. No. 324,892 filed Mar. 17, 1989 and now abandoned.

BACKGROUND OF THE INVENTION

(1) FIELD OF THE INVENTION

The present invention relates to lights having a wide angle radiation pattern and particularly to lights for public safety vehicle use. More specifically, this invention is directed to compound parabolic reflectors which direct light emitted by a single source in a plurality of directions and especially to multiple cooperating integral reflectors for use with multiple light sources of diverse types. Accordingly, the general objects of the present invention are to provide novel and improved devices of such character.

(2) DESCRIPTION OF THE PRIOR ART

Warning light systems intended for employment on emergency vehicles, such as police cars, ambulances, fire trucks and the like, are typically required to emit bursts of light which are readily visible from all sides of the vehicle. The warning lights of such systems may comprise a rotating or oscillating incandescent lamp assembly, a moving mirror and cooperating lamp or a stationary light source and cooperating fixed position lens and reflector. The prior art warning lights can be relatively expensive to manufacture. Additional drawbacks of many prior art warning lights are poor volumetric efficiency, high wind resistance, the inability to simultaneously employ diverse types of light generator and the inability to aim light generated by a single source in plural directions.

A number of improved lights having particular applicability to emergency vehicle warning light systems have recently been introduced. Many such lights employ xenon flash tubes and have found wide popularity. For example, U.S. Pat. No. 4,792,717, which is assigned to the assignee of the present invention, discloses a compact wide-angle warning light. This warning light employs a unique reflector with multiple reflective surfaces, a lens and a light emitter in the form of a specially designed xenon flash-tube. The reflector comprises a parabolic linear section disposed between parabolic dish end sections.

U.S. Pat. No. 4,954,938, which is also assigned to the assignee of the present invention, discloses a novel single emitter light assembly comprising a compound reflector and a lens which is mounted to and covers the reflector. The reflector includes a first parabolic dish-like reflective surface which forms a surface of revolution about a central axis. A light emitter mounting base projects from the first reflective surface and accepts a light emitter such as a halogen lamp or a gaseous discharge tube. The central axis extends through the emitter mounting base. A pair of reflector wings are located at equidistantly-spaced diametral positions from the central axis. The wings each define a parabolic reflector surface which has its axis canted in relation to the first reflector surface, i.e., the surfaces from which light is reflected are defined by three parabolas and these three parabolas have, to the extent manufacturing tolerances permit, a common focal point. The lens preferably includes a multiplicity of light spreaders, typically optical refracting ribs, which project interiorly from the lens surfaces. A pair of recesses are formed in the interior of the lens for mating with the outwardly disposed shoulder portions of the wings so as to mount the lens to the reflector and to angularly fix the orientation of the axes of the spreaders relative to the reflector. A source of radiation, optionally in the form of a halogen lamp or a gas discharge tube, is positioned in the envelope between the lens and the reflector at the common focal point of the reflector defined parabolas and produces a generally uni-directional, wide angle beam pattern which radiates through the lens.

SUMMARY OF THE INVENTION

Briefly stated, a light in accordance with a first embodiment of the present invention comprises a reflector assembly which defines a linear array consisting of at least a pair of concave reflectors and associated sockets for receiving and supporting light emitters. Each reflector of the linear array comprises a central portion, which is a portion of a paraboloid surface of revolution about a central axis through the socket, and a pair of laterally spaced parabolic end portions, which are also portions of parabolic surfaces of revolution about axes. The central portion and laterally spaced end portions all have a common focal point located on the central axis and light emitters mounted in the sockets will intersect the common focal point. The axes of the parabolas defined by the laterally spaced parabolic end portions intersect the central axis at the focal point at a cant angle whereby a two reflector light assembly array will define six substantially co-planar directional axes for reflected light. In one embodiment, the angles of intersection of the central axes with each axis of an end portion is approximately 35°.

In a preferred embodiment of the invention the central portion of each reflector is additionally provided with a pair of projections. These projections each comprise a pair of reflective surfaces of parabolic shape, i.e., portions of paraboloid surfaces of revolution about axes. The four parabolic reflective surfaces of the pair of projections of each reflector share the common focal point of the other three reflective surfaces of the reflector. Accordingly, each reflector of a linear array will be defined by seven different reflective surfaces which define parabolas having a common focal point. The two reflective surfaces of each projection are each canted in a first direction whereby the axes of the parabolas defined thereby intersect the central axis of the reflector at the focal point at an angle. In an embodiment where the cant angle of the pair of laterally spaced end portions of the reflector was 35°, the cant angle of each reflective surface defined by the projections was 45°. The axes of the paraboloid surfaces of revolution defined by each projection are also oriented relative to one another, i.e., the axes are each canted in a second direction, such that light reflected from the surfaces will be directed away from the plane of the six coplanar axes at preselected angle(s).

A particularly important feature of the present invention is the ability to simultaneously employ two different types of light generator, for example a xenon flash tube and an incandescent lamp such as a halogen gas filled lamp. Use of two such different light generators permits a two reflector linear array to, for example, function as both a warning light and a cornering light.

An object of the invention is to provide a new and improved light for employment on emergency vehicles.

Another object of the invention is to provide a new and improved reflector assembly for a light having a wide angle radiation pattern.

Another object of the invention is to provide a new and improved light which is compact while providing a high level of light intensity and a large illuminated region in relation to the physical size of the light.

A further object of the invention is to provide a new and improved dual emitter wide angle warning light which is capable of accepting either a halogen lamp or a gas discharge tube, or one of each, and is readily adaptable for installation on new emergency vehicles or retro-fitting on existing emergency vehicles.

Other objects and advantages of the invention will become apparent from the drawings and the specification.

DETAILED DESCRIPTION OF THE DISCLOSED EMBODIMENTS

Figure 1:
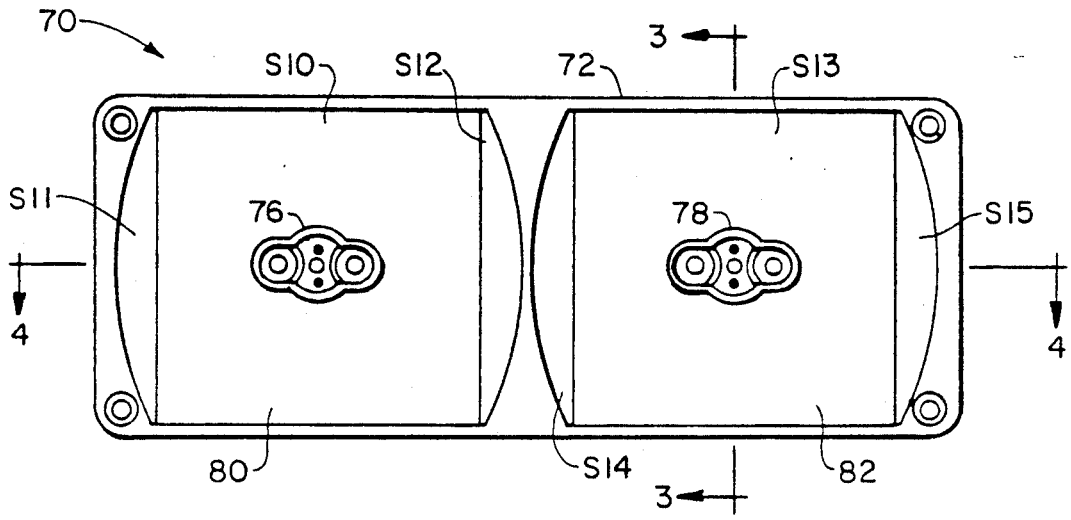
FIG. 1 is a front view of a reflector of a first embodiment of a dual emitter wide angle warning light in accordance with the present invention.
Figure 2:
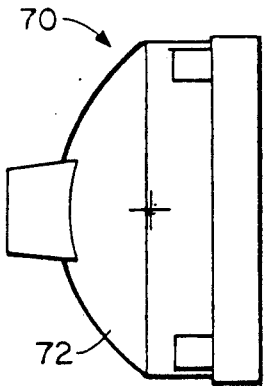
FIG. 2 is a side elevational view of the warning light of FIG. 1.
Figure 3:
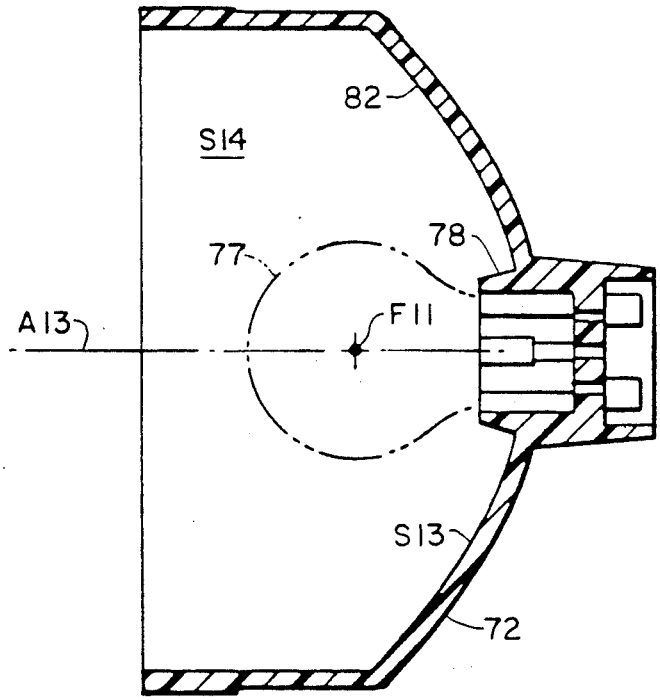
FIG. 3 is an enlarged sectional view, partly in diagrammatic form, of the reflector of FIG. 1 taken along the line 3—3 of FIG. 1.
Figure 4:
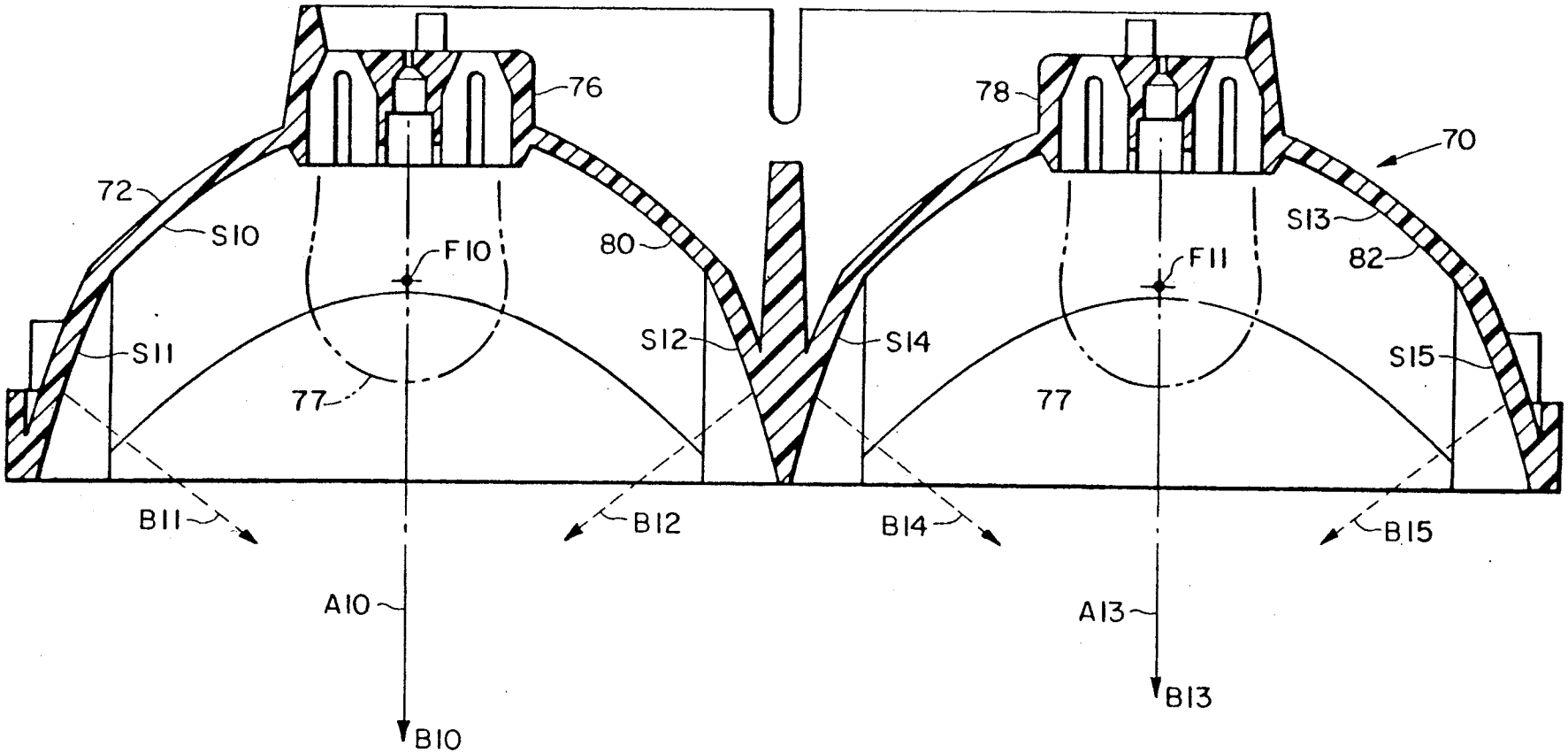
FIG. 4 is an enlarged sectional view, partly in diagrammatic form, of the reflector of FIG. 1 taken along the line 4—4 of FIG. 1.

With reference to the drawings, Wherein like numerals represent like elements throughout the Figures, in FIGS. 1-5 a first embodiment of a two reflector linear array wide angle light in accordance with the present invention is generally indicated by the numeral 70. Light 70 comprises a reflector subassembly 72 and a lens 74 which mounts to the reflector. Lens 74 may include integral optical spreader ribs 75 or prisms, typically on the surface thereof which faces the reflector, to redirect light received directly from the emitters and light reflected from the reflectors.

The reflector subassembly 72 comprises two laterally spaced sockets 76 and 78. Each socket is capable of receiving a light generator as schematically represented at 77. The light generator may be either a halogen lamp as indicated at 77' in FIGS. 5 and 10, or a xenon flash tube, as indicated at 77'' in FIG. 10. The sockets are designed to support the light generators such that a light emitting portion thereof will lie on the focal point of an associated reflector. Each of the sockets 76, 78 has associated therewith a respective concave reflector 80, 82. Axis A10 extends through the center of socket 76 and reflector 80, and axis A13 extends through the center of socket 78 and reflector 82. The reflectors 80 and 82 are substantially identical and are each defined by three parabolic surfaces. A continuous reflective coating is applied to all of the reflector surfaces and the sockets to provide an optically efficient compound reflector.

Figure 9:
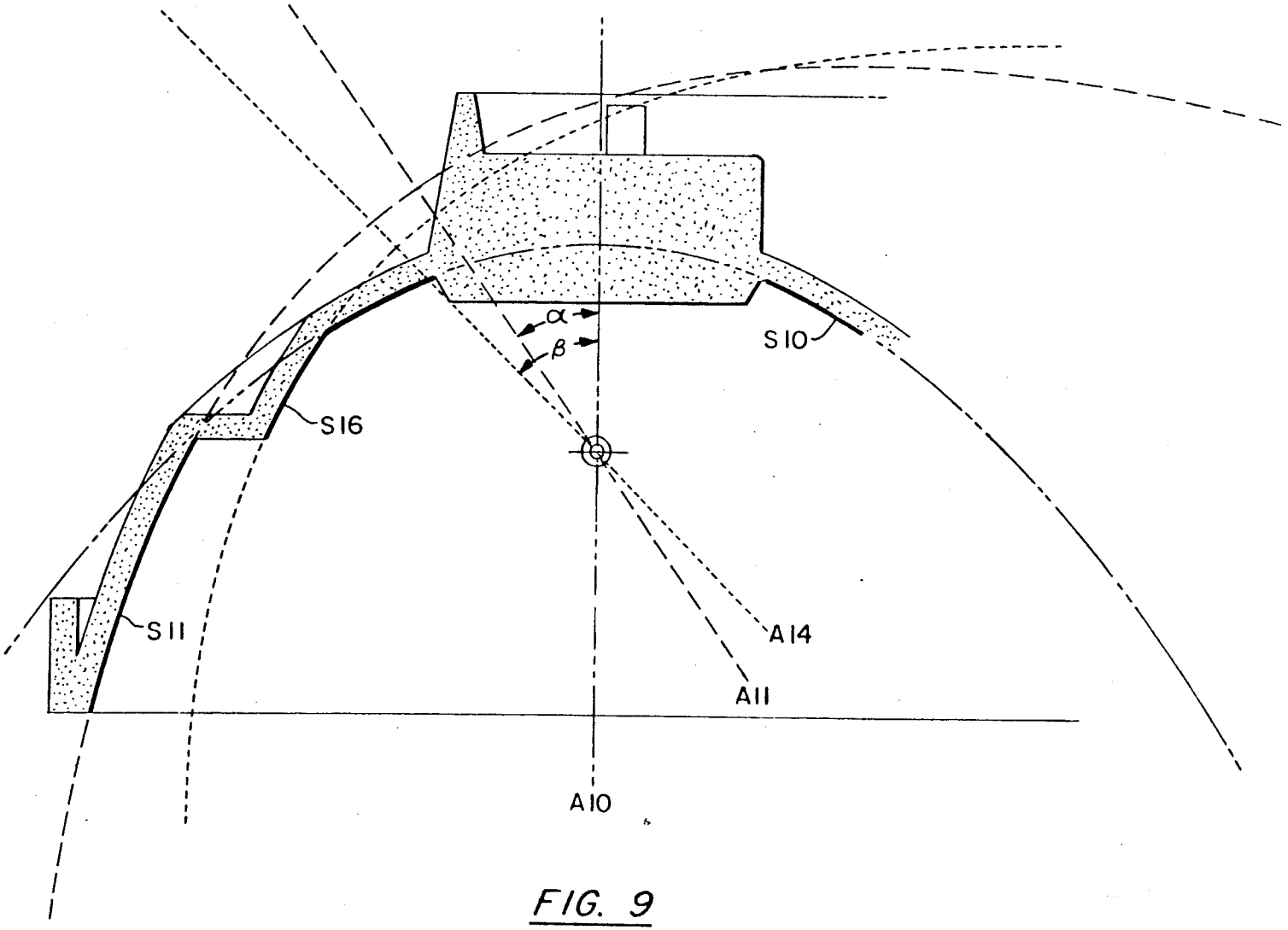
FIG. 9 is a partial enlarged view, taken in the same direction as FIG. 8, which schematically illustrates the construction of a reflector for a light in accordance with the present invention.

Reflector 80 comprises a central reflective surface S10, which is essentially a segment of a paraboloid of revolution about the central axis A10 through the socket 76. A pair of opposing parabolic end surfaces S11 and S12, having substantially the same shape and mirror orientation and also being segments of paraboloids of revolution, are disposed at laterally spaced portions of the parabolic segment surface S10. The focal points of the paraboloids of revolution which include surfaces S10, S11, and S12 coincide at a single focal point F10. Focal point F10 lies on axis A10 and, as noted above, is intersected by a light emitting portion of light generator 77 mounted in socket 76. As best seen from FIG. 9, which depicts the axis A11 of the paraboloid of revolution which defines surface S11, the axes of the parabolas defined by surfaces S11 and S12 are canted at acute angles $\alpha$ relative to the axis A10. FIG. 9 through the use of broken line showings of different form, also depicts the parabolas defined by reflective surfaces S10 and S11 of reflector 72.

Reflectors 80 and 82 are substantially identical in shape and dimensions. It should thus be appreciated that reflector 82 likewise comprises a central parabolic dish-like surface S13, which is substantially identical in shape to surface S10, and parabolic end surfaces S14 and S15, which are substantially identical in shape to respective surfaces S11 and S12. Surface S13 is a parabolic surface of revolution about axis A13. The axes of the paraboloids of revolution which define surfaces S14 and S15 are canted at an acute angle to the axis A13 and intersect axis A13 at focal point F11. Reflectors 80 and 82 cooperate to form a two unit linear array having six co-planar directional axes of high light intensity, i.e., light reflected from each of surfaces S10, S11, S12, S13, S14 and S15 will in the known manner be projected as a beam as indicated respectively by broken lines B10, B11, B12, B13, B14 and B15 in FIG. 4.

Figure 5:
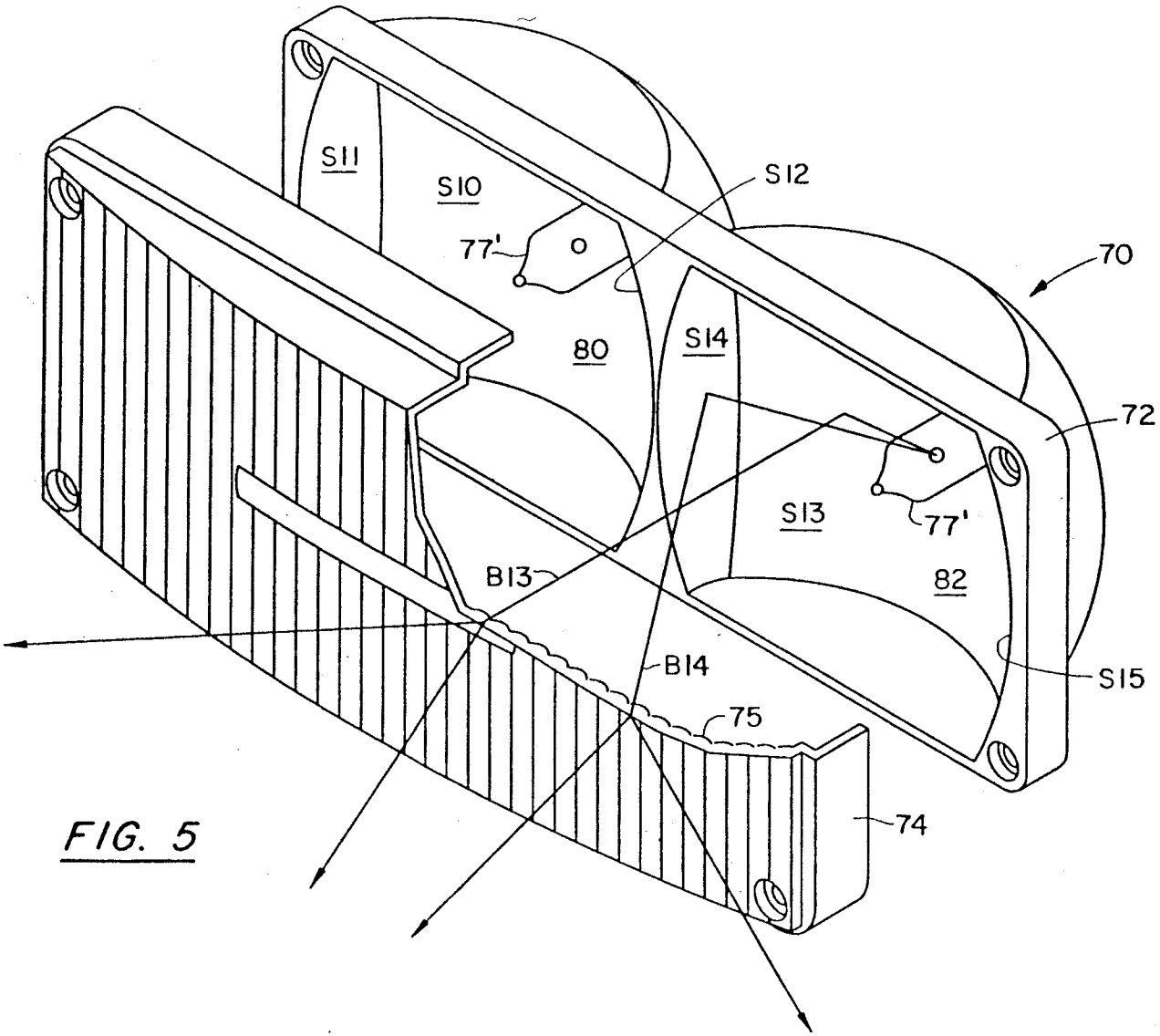
FIG. 5 is a perspective view, exploded and partly broken away, of the reflector of FIGS. 1-4 and an associated lens.
Figure 6:
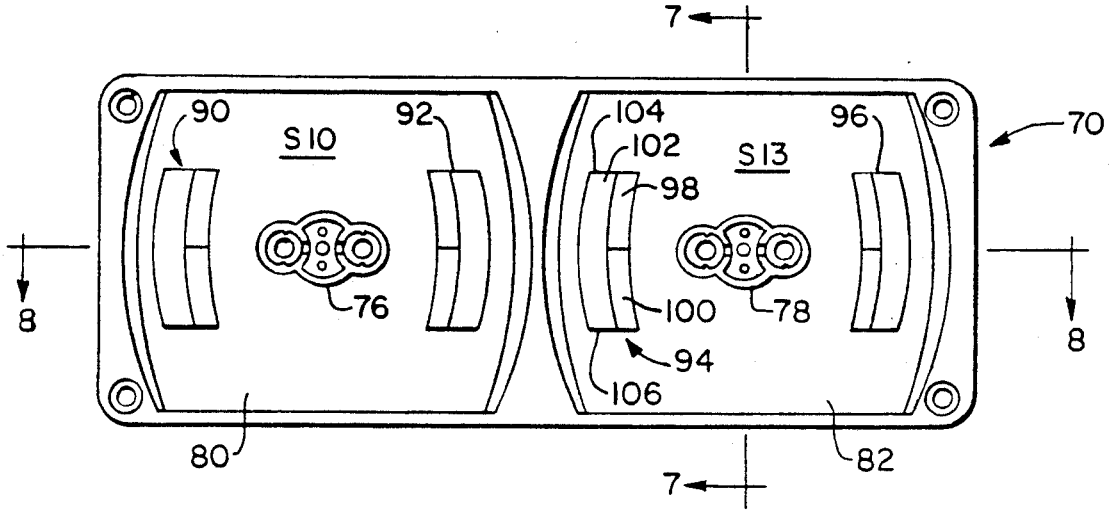
FIG. 6 is a view similar to FIG. 1 depicting a reflector assembly of a second embodiment of the present invention.
Figure 7:
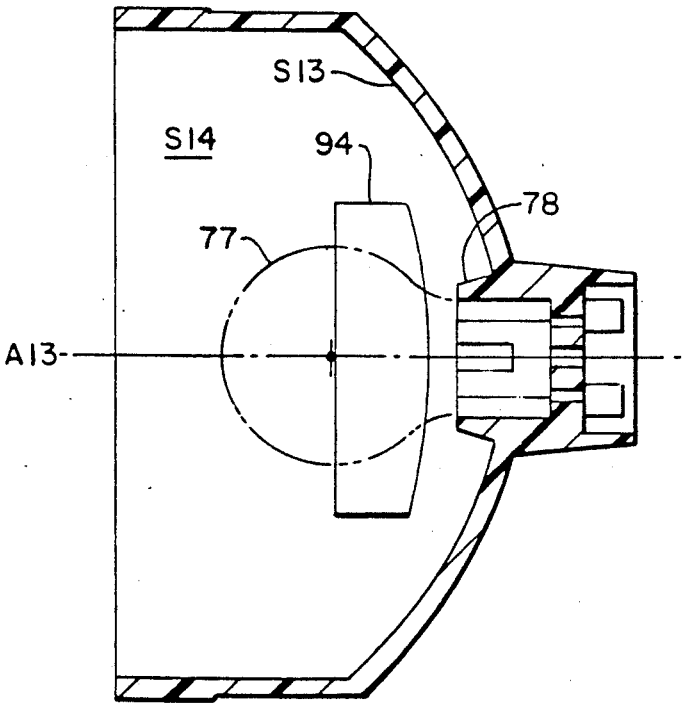
FIG. 7 is a cross-sectional view of the reflector of FIG. 6 taken in the same direction as FIG. 3.
Figure 8:
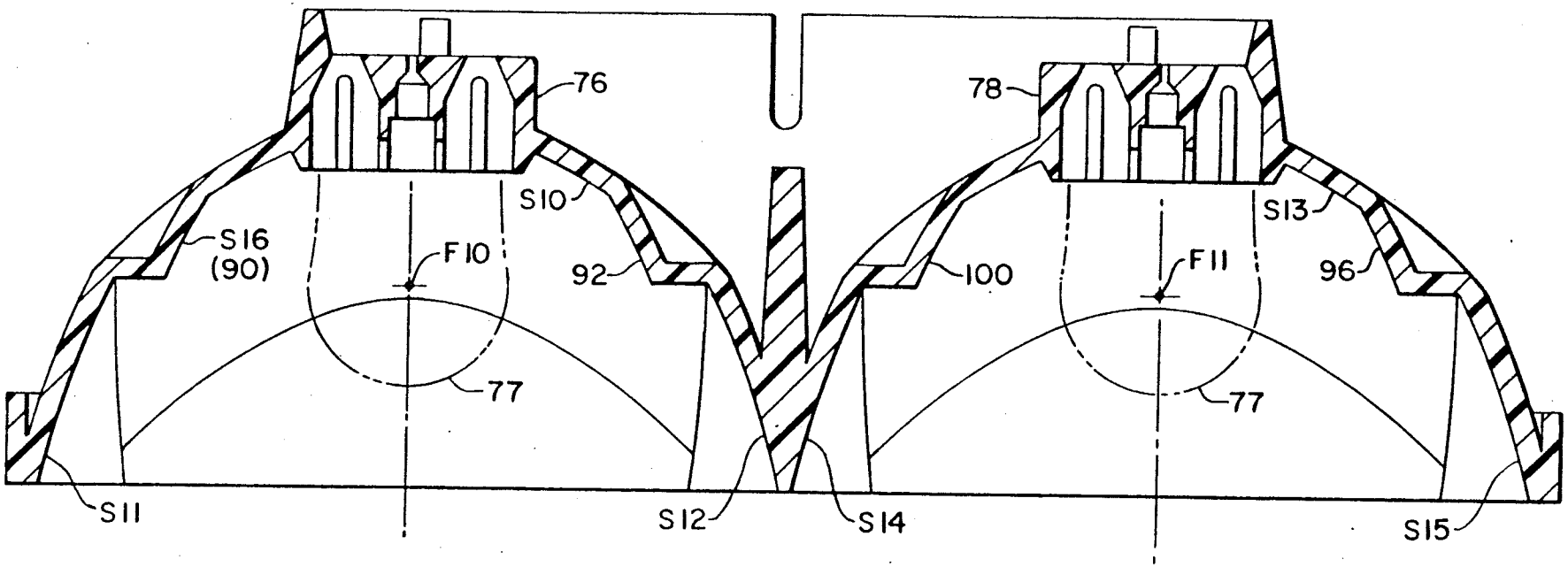
FIG. 8 is a view, similar to FIG. 4, of the reflector of FIGS. 6 and 7.

As shown in FIG. 5, the light beams emanating from the parabolic reflective surfaces will pass through lens 74. In the disclosed embodiment the lens 74 is provided with internal surface irregularities, spaced optical spreader bars 75 for example, which redirect incident light in a desired direction. Where a wide angle radiation pattern is desired, the light will be redirected by the lens generally about a horizontal plane which is defined by the axes of the paraboloids of revolution. If the light is to be employed as an integral cornering light and warning light, the lens portion in alignment with the reflector which comprises the cornering light will be provided with optics which redirects the directly received and reflected light downwardly and this lens portion will typically be clear. The lens portion which is in registration with the reflector which comprises the warning light will typically be provided with spreader optics and will be colored.

EXAMPLE

In one example of a reflector for light 70, the distance between focal point F10 and the vertex of surface S10 is 0.687 inches. The distance between each of surfaces S11 and S12 and focal point F10 is 1.062 inches. The axes of the parabolas defined by end reflector surfaces S11 and S12 are canted at an angle of 35° relative to the central focal axis A10 through surface S10. Analogous relationships are present for surfaces S13, S14 and S15. The transverse distance from focal point F10 to the interface between surfaces S10 and S11 is 1.33 inches. The lateral transverse dimensional width of the reflector 72 is approximately 7.00 inches.

It will be appreciated that the reflectors of each pair of reflectors which form the light 70 comprise co-linear cooperative parabolic sections which define portions of paraboloids of revolution about various directional axes. The foregoing arrangements of reflective surfaces results in an enhanced reflection for each of the light generators of a dual emitter light so as to increase the intensity and enhance the directional capabilities of the light. The reflector configurations are also achieved within the constraints of a relatively small reflector depth. Reflector depth is an important constraint since the lights may be mounted in the side walls of a vehicle. The reflected radiation and light received directly from the light source may be dispersed in a plane by optical spreaders or may be aimed by prisms of a Fresnel lens which are integral with the lens 74 to achieve a desired radiation pattern.

Referring now to FIGS. 6–11, a preferred embodiment of a reflector for a light in accordance with the present invention is shown. This preferred embodiment differs from the reflector assembly discussed above by the addition, to each of reflectors 80 and 82, of a pair of projections. In the case of reflector 80, the projections are indicated generally at 90 and 92 and, in the case of reflector 82, the projections are indicated at 94 and 96. In the disclosed embodiment, these four projections are identical with the two projections in each reflector being oppositely disposed as shown. Referencing projection 94 for purposes of explanation, this projection defines two adjoining parabolic reflective surfaces S16 and S18 which are most clearly seen from FIG. 10. The line where the surfaces S16 and S18 meet lies on the horizontal plane defined by axes A10 and A13. Projection 94 also has a top surface 102 and a pair of side surfaces 104, 106 which serve simply to connect the surfaces S16 and S18 to the surface S13. The paraboloids of revolution defined by reflective surfaces S16 and S18 each have their focal points at the common focal point F11 of surfaces S13, S14 and S15. As will be apparent to those skilled in the art from FIG. 9, which shows axis A14 associated with surface S16, the axes of the parabolas defined by surfaces S16 and S18 are canted at an acute angle $\beta$ relative to the axes A10 and A11 on which the common focal points F10 and F11 lie. The cant angles of axes of the parabolas of surfaces S16 and S18 will typically be the same and will be different from the cant angle of the axes of the surfaces S14 and S15 (or S11 and S12). Thus, referring to FIG. 9, the axis A14 of surface S16 of projection 90, in one reduction to practice where the axes A11 of end reflector surface S11 was canted at an angle of $\alpha$ of 35° and the axis of reflector S12 was canted at the same angle, was canted at an angle $\alpha$ of 45° relative to axis A10.

Figure 10:
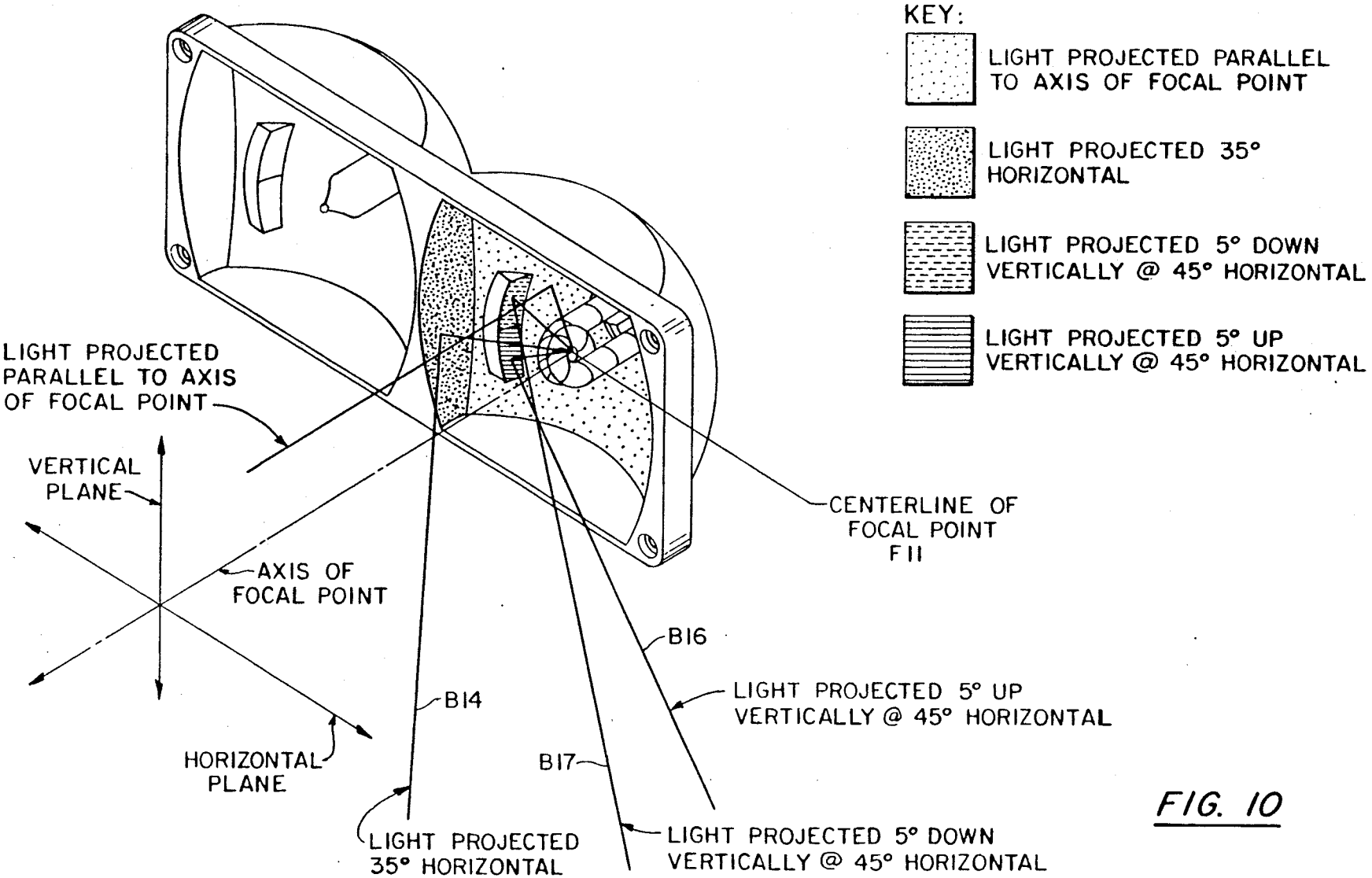
FIG. 10 is a perspective view of the reflector assembly of FIGS. 6-9 with different types of light emitter installed in the sockets.

The surfaces S16 and S18 are also oriented, i.e., the axes of the paraboloids of revolution which include these surfaces are tilted relative to the horizontal plane defined by axes A10 and A13, to achieve the result shown in FIG. 10. Thus, the light beams represented at B16 and B17 resulting from the focusing action of a pair of adjoining surfaces S16, S18 will be directed away from the horizontal plane.

The addition of the projections 90–96 to the reflectors 80 and 82 enables the "fine tuning" of the radiation pattern from the light assembly. Thus, the projections and their design, particularly the cant angles of the axes of the paraboloids of revolution which are defined by the surfaces of the projections relative to the center axes of the associated reflector and the angle of intersection of these axes with the plane defined by axes A10 and A13, permits the creation of the light pattern represented in FIG. 11. FIG. 11 is keyed to FIG. 10 by shading the reflective surfaces in FIG. 10 and representing the light pattern resulting from the reflection off these surfaces with the same shading in FIG. 11.

Figure 11A:
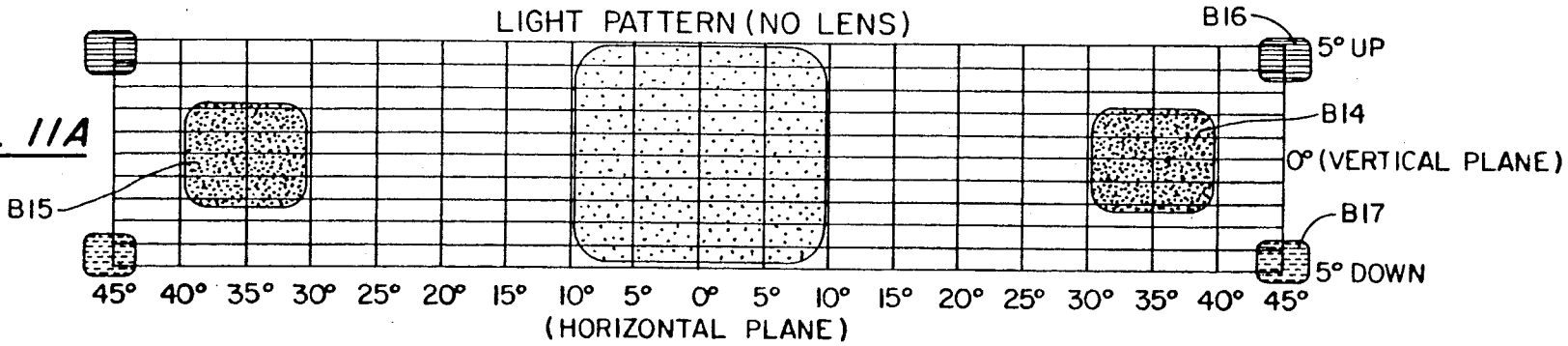
FIG. 11 is representation, related by shading to FIG. 10, of the light pattern produced by the reflector of FIGS. 6-10 when directly viewed and when viewed through a lens having a uniform pattern of optical spreaders.
Figure 11B:
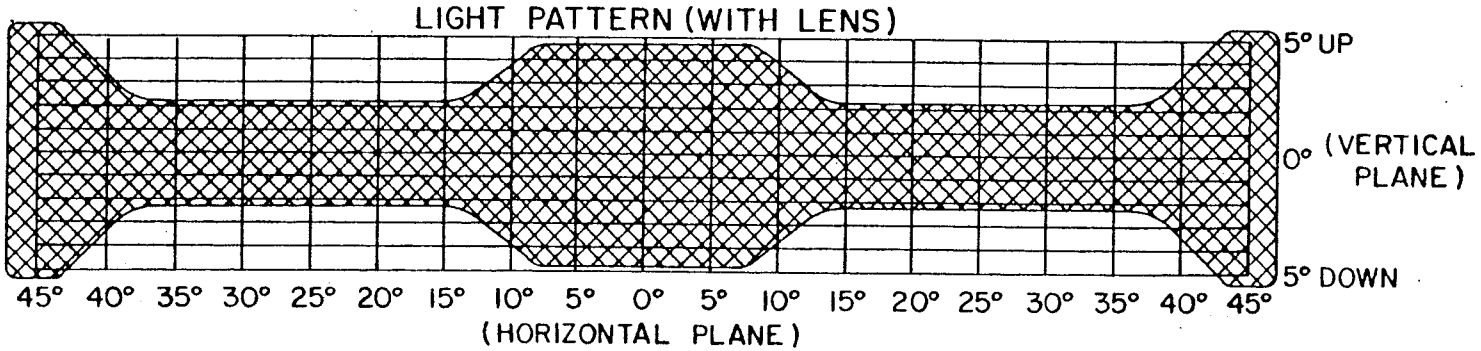
Figure 11:
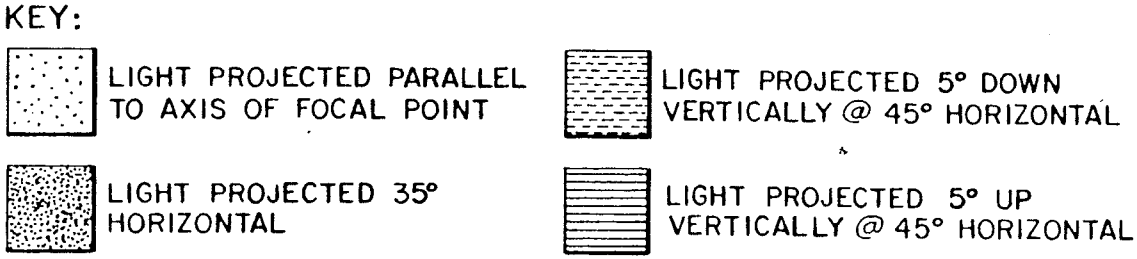

FIG. 11A depicts the light pattern produced by one of the reflectors of the two reflector array of FIGS. 6–10 with no lens to redirect the light. It may be seen that the reflective surfaces of the projections produce beams, i.e., enhanced intensity, directed toward the corners of the pattern. In the disclosed embodiment where the cant angles associated with the projections are 45° and the tilt angles are 5°, the "hot" spots were located 5° above and below the horizontal plane as shown. With a 35° cant angle of the end reflectors, the "spots" resulting therefrom were located about the horizontal plane and inwardly toward the center axis with respect to the corner "spots". FIG. 11B represents the effect of passing the light pattern of FIG. 11A through the lens 74 of FIG. 5 which has optical spreader optics 75.

While preferred embodiments have been set forth for purposes of illustration, the foregoing description should not be deemed a limitation of the invention disclosed herein. Accordingly, various modifications, adaptations and alternatives may occur to one skilled in the art without departing from the spirit and the scope of the present invention. For example, while the focal points F10 and F11 have been depicted as being on the reflector side of a vertical plane defined by the reflector/lens interface, the focal points could be on the opposite side of this plane.

What is claimed is:

1. A light having a wide angle radiation pattern comprising:

housing means comprising at least a pair of laterally spaced socket means for mounting respective light generators, each said socket means having an associated concave reflector, each said reflector comprising a first reflective surface which is a portion of a paraboloid of revolution about a first axis through said socket means, the axes of said reflector first surfaces defining a plane, each said reflector further comprising second and third laterally spaced reflective surfaces which are portions of paraboloids of revolution respectively about second and third axes, said paraboloids of revolution all having a common focal point located on said first axis, said second and third axes generally lying in said plane and being canted relative to said first axis whereby said housing means defines at least six coplanar directional axes of high intensity light emission; and a light generator supported in each of said socket means, a light emitting portion of each said generator being located on said common focal point.

2. The light of claim 1 wherein said concave reflectors have substantially identical shapes.

3. The light of claim 1 wherein said laterally spaced reflective surfaces merge with an associated first reflective surface and have substantially identical shapes.

4. The light of claim 1 wherein said first cant angle is approximately 35°.

5. The light of claim 2 wherein said laterally spaced reflective surfaces merge with an associated first reflective surface and are canted at the same angle, and wherein said laterally spaced reflective surfaces are generally oppositely oriented whereby the said axes of said second and third surfaces will intersect at their common focal point.

6. The light of claim 1 wherein said first axes are oriented generally parallel to one another.

7. The light of claim 5 wherein said first axes are oriented generally parallel to one another.

8. The light of claim 1 wherein each said reflector further comprises at least a first projection extending from each of said first reflective surfaces, said projections each defining at least a pair of additional reflective surfaces which are portions of paraboloids of revolution about respective axes, said reflective surfaces of said projections each having a focal point, the focal points of said reflective surfaces of said projections being generally coincident with said common focal points, the axes of the paraboloids which define said reflective surfaces of each projection being canted relative to said first axes.

9. The light of claim 8 wherein there are a pair of said projections extending from each of said first reflective surfaces, the cant angles of said axes of said projection defined reflective surfaces being different than said first angle, and wherein a pair of reflective surfaces defined by each projection are located on opposite sides of said plane.

10. The light of claim 8 wherein said cant angles of said projection defined reflective surfaces are all the same.

11. The light of claim 9 wherein said cant angles of said projection defined reflective surfaces are all the same.

12. The light of claim 8 wherein the axes of the reflective surfaces defined by each projection intersect said plane at an angle.

13. The light of claim 9 wherein the axes of the reflective surfaces defined by each projection intersect said plane at an angle.

14. The light of claim 13 wherein said cant angles of said projection defined reflective surfaces are all the same.

15. The light of claim 14 wherein the cant angles of said projection defined reflective surfaces are different than said first angle.

16. The light of claim 8 wherein said laterally spaced reflective surfaces have substantially the same shape and are canted at the same angle and said laterally spaced reflective surfaces are generally oppositely oriented whereby the said axes of said second and third surfaces intersect, the said first axes of said reflectors being oriented generally parallel to one another.

17. The light of claim 11 wherein said laterally spaced reflective surfaces have substantially the same shape and are canted at the same angle and said laterally spaced reflective surfaces are generally oppositely oriented whereby the said axes of said second and third surfaces intersect, the said first axes of said reflectors being oriented generally parallel to one another.

18. The light of claim 13 wherein said laterally spaced reflective surfaces have substantially the same shape and are canted at the same angle and said laterally spaced reflective surfaces are generally oppositely oriented whereby the said axes of said second and third surfaces intersect, the said first axes of said reflectors being oriented generally parallel to one another.

19. The light of claim 15 wherein said laterally spaced reflective surfaces have substantially the same shape and are canted at the same angle and said laterally spaced reflective surfaces are generally oppositely oriented whereby the said axes of said second and third surfaces intersect, the said first axes of said reflectors being oriented generally parallel to one another.

20. The light of claim 1 wherein said light generators respectively comprise a gaseous discharge tube and an incandescent lamp.

21. The light of claim 7 wherein said light generators respectively comprise a gaseous discharge tube and an incandescent lamp.

22. The light of claim 8 wherein said light generators respectively comprise a gaseous discharge tube and an incandescent lamp.

23. The light of claim 19 wherein said light generators respectively comprise a gaseous discharge tube and an incandescent lamp.

24. A reflector comprising:

a first reflective surface, said first surface being a portion of a paraboloid of revolution about a first axis, said paraboloid of revolution having a focal point;

a second reflective surface extending from said first surface, said second surface being a portion of a paraboloid of revolution about a second axis, the paraboloid of revolution of said second surface having the same focal point as that of said first surface, the axes of said paraboloids being coplanar and intersecting at said focal point;

a third reflective surface extending from said first surface, said third surface being a portion of a paraboloid of revolution about a third axis, the paraboloid of revolution of said third surface having a common focal point with those of said first and second surfaces, said third axis being coplanar with said first and second axes and intersecting said first and second axes at said common focal point, said third surface being spaced from and oppositely disposed relative to said second surface;

a pair of spacially displaced and oppositely disposed projections extending from said first surface, said projections extending to both sides of the plane defined by said first, second and third axes, said projections each defining a pair of reflective surfaces which are portions of paraboloids of revolution about an axis, the paraboloid of revolution of each of said projection defined surfaces having a focal point which coincides with said common focal point, said reflective surfaces of each pair being located at opposite sides of said plane, the axis of the paraboloid of revolution of each surface of each pair intersecting said plane at an angle, the axis of the paraboloid of revolution of each surface of each pair also intersecting said first axis at an angle, the angle of intersection of each said projection defined paraboloid axis with said first axis being different from the angle of intersection of said first and second axes; and means for supporting a light generator such that a light emitting portion thereof is coincident with said common focal point.

* * * * *